US009337567B2

(12) United States Patent
Rangi et al.

(10) Patent No.: US 9,337,567 B2
(45) Date of Patent: May 10, 2016

(54) SEAL FOR AN ELECTRIC TERMINAL

(71) Applicant: Lear Corporation, Southfield, MI (US)

(72) Inventors: Bhupinder Rangi, Novi, MI (US); David Menzies, Linden, MI (US); Eric Torrey, Beverly Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/620,286

(22) Filed: Feb. 12, 2015

(65) Prior Publication Data

US 2015/0280354 A1 Oct. 1, 2015

Related U.S. Application Data

(60) Provisional application No. 61/972,763, filed on Mar. 31, 2014.

(51) Int. Cl.
*H01R 13/40* (2006.01)
*H01R 13/52* (2006.01)

(52) U.S. Cl.
CPC ..... *H01R 13/5202* (2013.01); *H01R 13/521* (2013.01); *H01R 13/5213* (2013.01); *H01R 2201/26* (2013.01)

(58) Field of Classification Search
CPC ..... H01R 13/5219; H01R 13/5208; H01R 13/5205; H01R 4/183; H01R 11/12; H01R 13/04; H01R 4/185
USPC ..... 439/271, 275, 587, 589, 881, 883, 884, 439/877
See application file for complete search history.

(56) References Cited

U.S. PATENT DOCUMENTS 3,922,477 A * 11/1975 Glowacz ..... H01R 13/746 174/18
6,059,594 A * 5/2000 Davis ..... H01R 13/5205 439/275
6,815,610 B2 * 11/2004 Kuboshima ..... H01R 9/032 174/360
7,063,566 B2 * 6/2006 Tsuchiya ..... H01R 13/4223 439/587
7,070,449 B2 * 7/2006 Miyazaki ..... H01R 9/032 439/272
7,077,676 B2 * 7/2006 Matsumoto ..... H01R 13/5205 439/271
7,079,498 B2 * 7/2006 Ubale ..... H04B 3/23 370/286
7,530,843 B1 * 5/2009 Tesfay ..... H01R 4/183 439/587
7,854,629 B1 * 12/2010 Albers ..... E21B 17/023 439/271
8,128,431 B2 * 3/2012 Kato ..... H01R 13/521 439/271
8,449,328 B2 * 5/2013 Ooki ..... C08L 53/025 439/271
8,905,784 B2 * 12/2014 Perotto ..... B29C 45/14639 439/587
2012/0186391 A1 7/2012 Boskovitch et al.
2013/0057096 A1 3/2013 Okada et al.

FOREIGN PATENT DOCUMENTS

EP 0138739 A1 4/1985
EP 1526027 A2 4/2005

* cited by examiner

*Primary Examiner* — Thanh Tam Le
(74) *Attorney, Agent, or Firm* — MacMillan, Sobanski & Todd, LLC

(57) ABSTRACT

A sealed terminal housing includes a header that defines a terminal opening. An electric terminal extends through the terminal opening. The electric terminal includes a terminal stop. A terminal seal is located in the terminal opening and is compressed against the header and the electric terminal. A seal cap is also located in the terminal opening and engages the header and the terminal stop.

15 Claims, 4 Drawing Sheets

SEAL FOR AN ELECTRIC TERMINAL

CROSS-REFERENCE TO RELATED APPLICATIONS

This application claims the benefit of U.S. Provisional Application No. 61/972,763, filed Mar. 31, 2014, the disclosure of which is incorporated herein by reference.

BACKGROUND OF THE INVENTION

This invention relates in general to an electric connector for providing an electric connection to a sealed environment. More specifically, this invention relates to a seal for an electric terminal.

Sealed environments may be found in a variety of different situations. For example, sealed environments may be provided in situations when it is desired to work with high or low pressure fluids, or situations in which it is desired to isolate a space from outside contaminants Such an environment will typically include an enclosure that separates the sealed environment from the surroundings. These sealed environments may contain electric equipment that requires a connection to other equipment that is located outside of the sealed environment. For example, a piece of equipment inside the sealed environment may include an electric connection to a power source outside the sealed environment. This electric connection passes through the enclosure and introduces a potential point of failure for the sealed environment. Therefore, the electric connection itself is typically sealed in order to preserve the integrity of the sealed environment.

A particular example of a sealed environment is a vehicle transmission, which includes a transmission fluid that may be at a relatively high temperature and pressure. The transmission includes a housing that is sealed to prevent the fluid from escaping. The vehicle transmission may include electric components that require an electric connection to other components outside the housing. This electric connection is sealed in order to prevent the transmission fluid from escaping from the housing, and it is desirable that the seal remain in the proper position in order to maintain the integrity of the seal. Typically, this is accomplished by using adhesives to connect a seal to an electric terminal that passes through the housing. It would be advantageous to have an improved way of providing a seal on the electric connection.

SUMMARY OF THE INVENTION

This invention relates to a sealed terminal housing. The sealed terminal housing includes a header that defines a terminal opening. An electric terminal extends through the terminal opening. The electric terminal includes a terminal stop. A terminal seal is located in the terminal opening and is compressed against the header and the electric terminal. A seal cap is also located in the terminal opening and engages the header and the terminal stop.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
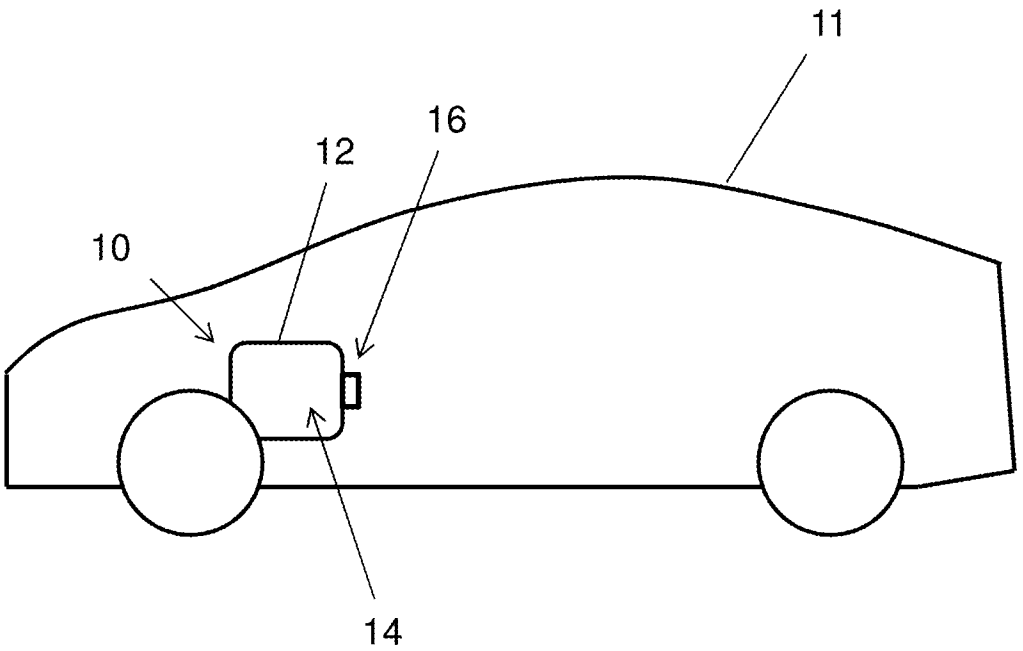
FIG. 1 is a schematic view of a vehicle that includes a transmission housing with an electric header.

Referring now to the drawings, there is illustrated in FIG. 1 a schematic view of a vehicle 11. The illustrated vehicle 11 is a hybrid-electric vehicle, but may be any desired type of vehicle. The vehicle 11 includes a transmission housing, indicated generally at 10. The transmission housing 10 includes an enclosure 12 that defines an interior space, indicated at 14. The transmission housing 10 includes an electric header, indicated generally at 16, that allows electric current to be passed through the enclosure 12 to one or more electric components (not shown) located in the interior space 14. It should be appreciated that when assembled and in normal use, the transmission housing 10 will contain a transmission fluid (not shown). It is desirable that the transmission fluid not escape from the transmission housing 10, and so the electric header 16 is sealed.

Figure 3:
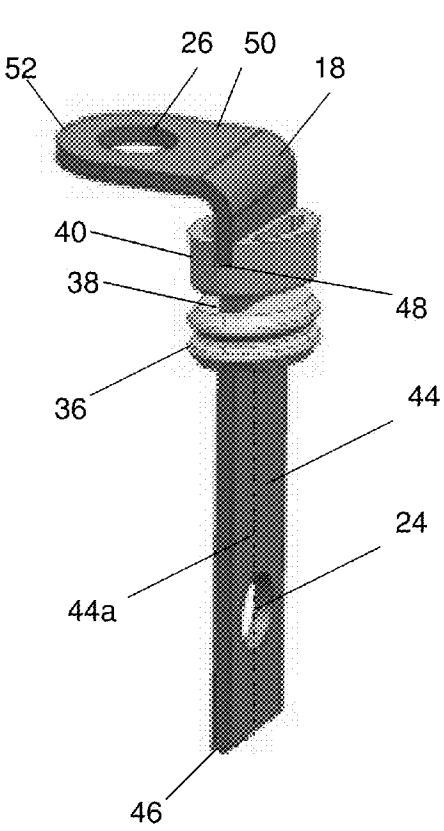
FIG. 3 is a perspective view of an electric terminal from the electric header, shown with a terminal seal and a seal cap attached.
Figure 2:
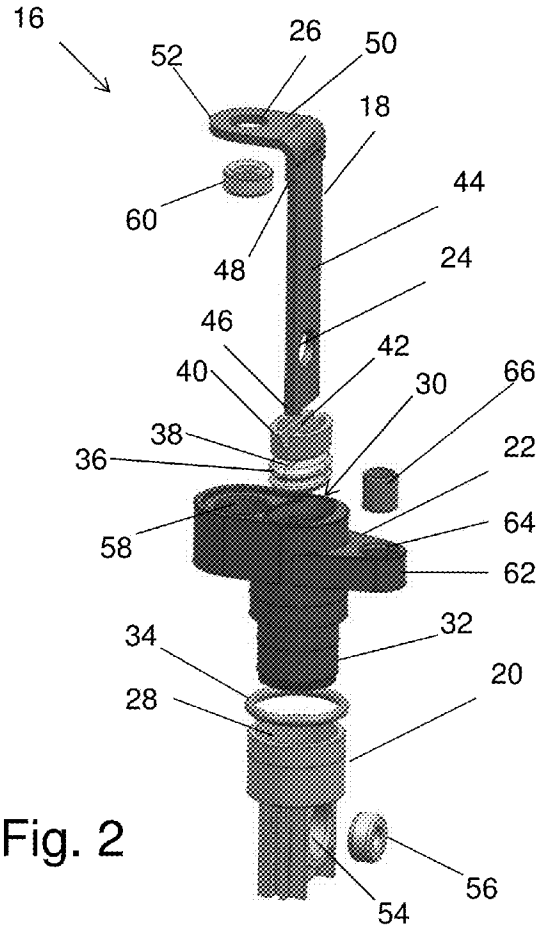
FIG. 2 is an exploded, perspective view of the electric header.

Referring now to FIG. 2, an exploded view of the electric header 16 is shown. The electric header 16 includes an electric terminal 18, an interior header part 20, and an exterior header part 22. The illustrated electric terminal 18 is made of silver-plated copper and is stamped from a piece of sheet metal. However, the electric terminal 18 may be made of any desired material or materials and by any desired method. The electric terminal 18 defines an interior termination opening 24 and an exterior termination opening 26 that allow electric current-carrying leads (not shown) to be attached to the electric terminal 18. However, the electric terminal 18 may include any desired attachment mechanism. As best seen in FIG. 3, the electric terminal 18 includes an inner portion 44 that extends between an inner end 46 and a terminal stop 48. The inner portion 44 has an inner axis 44*a* that extends from the inner end 46 to the terminal stop 48. The electric terminal 18 includes an outer portion 50 that extends between the terminal stop 48 and an outer end 52 of the electric terminal 18.

The interior header part 20 of the electric header 16 is adapted to be located within the interior space 14 of the transmission housing 10 when the electric header 16 is installed on the transmission housing 10. The illustrated interior header part 20 is made of a high temperature thermoplastic polymer, but may be made of any desired material. The interior header part 20 defines an interior terminal opening 28 that serves to accommodate a part of the electric terminal 18 and a part of the external header part 22 when the electric header 16 is assembled, as will be described below.

The exterior header part 22 of the electric header 16 is adapted to be located outside the interior space 14 of the transmission housing 10 when the electric header 16 is installed on the transmission housing 10. The illustrated exterior header part 22 is made of a high temperature thermoplastic polymer, but may be made of any desired material. The external header part 22 defines an external terminal opening, indicated generally at 30, that serves to accommodate a part of the electric terminal 18 when the electric header 16 is assembled. The external header part 22 includes an insertion end 32 that is inserted into the internal terminal opening 28 when the electric header 16 is assembled.

The electric header 16 includes an intermediate seal 34 that is located between the internal header part 20 and the external header part 22 when the electric header 16 is assembled. The illustrated intermediate seal 34 is an O-ring that provides a seal between the assembled electric header 16 and the wall 12 when the electric header 16 is installed on the transmission housing 10. It should be appreciated that the intermediate seal 34 may have any other desired shape. The illustrated intermediate seal 34 is made of a fluoroelastomer synthetic rubber, but the intermediate seal 34 may be made of any desired material.

The electric header 16 also includes a terminal seal 36 that is located between the electric terminal 18 and the external header part 22 when the electric header 16 is assembled. The illustrated terminal seal 36 is made of a fluoroelastomer synthetic rubber, but may be made of any desired material. The terminal seal 36 has a substantially oval shape in a cross-section taken perpendicular to the inner axis 44*a* of the electric terminal 18. The terminal seal 36 defines a seal terminal opening 38 adapted to accommodate part of the electric terminal 18. The electric header 16 also includes a seal cap 40. The illustrated seal cap 40 is made of polyphthalamide, but may be made of any desired material. The seal cap 40 has a substantially oval shape in a cross-section taken perpendicular to the inner axis 44*a* of the electric terminal 18. The seal cap 40 defines a cap terminal opening 42 adapted to accommodate part of the electric terminal 18.

The terminal stop 48 serves to position the seal cap 40 relative to the electric terminal 18, as will be described below. In the illustrated electric terminal 18, the outer portion 50 is wider than the inner portion 44, and the terminal stop 48 is the location at which the width the electric terminal 18 changes. However, it should be appreciated that the terminal stop 48 may be any desired positioning feature. For example, the inner portion 44 and the outer portion 50 could have the same widths, and the terminal stop 48 could be one or more discrete tabs located on the electric terminal 18.

Referring to FIG. 3, the electric terminal 18 is shown with the terminal seal 36 and the seal cap 40 installed thereon. As shown, the inner portion 44 of the electric terminal 18 passes through the cap terminal opening 42, and the seal cap 40 abuts the terminal stop 48. Further, the inner portion 44 of the electric terminal 18 passes through the seal terminal opening 38, and the terminal seal 36 is located between the seal cap 40 and the inner end 46 of the electric terminal 18.

Figure 4:
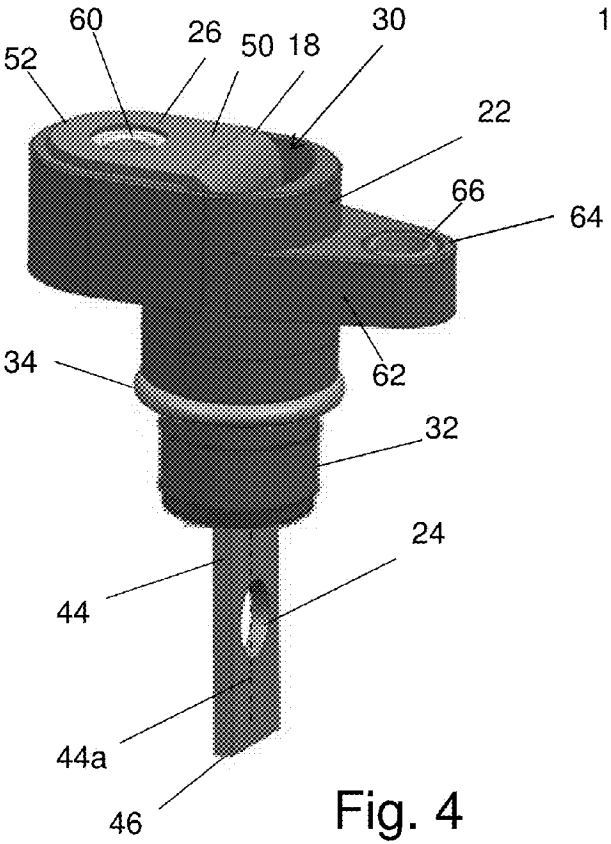
FIG. 4 is an enlarged, perspective view of the electric header partially assembled, with the electric terminal connected to an external header part.

Referring to FIG. 4, a perspective view of the partially-assembled electric header 16 is shown. The electric terminal 18 with the terminal seal 36 and the seal cap 40 are inserted into the external terminal opening 30 of the external header part 22. The external terminal opening 30 allows the inner end 46 of the electric terminal 18 to pass through the external header part 22. It should be appreciated that the terminal seal 36 and the seal cap 40 are located in the external terminal opening 30. The intermediate seal 34 is also shown positioned on the insertion end 32 of the external header part 22.

Figure 5:
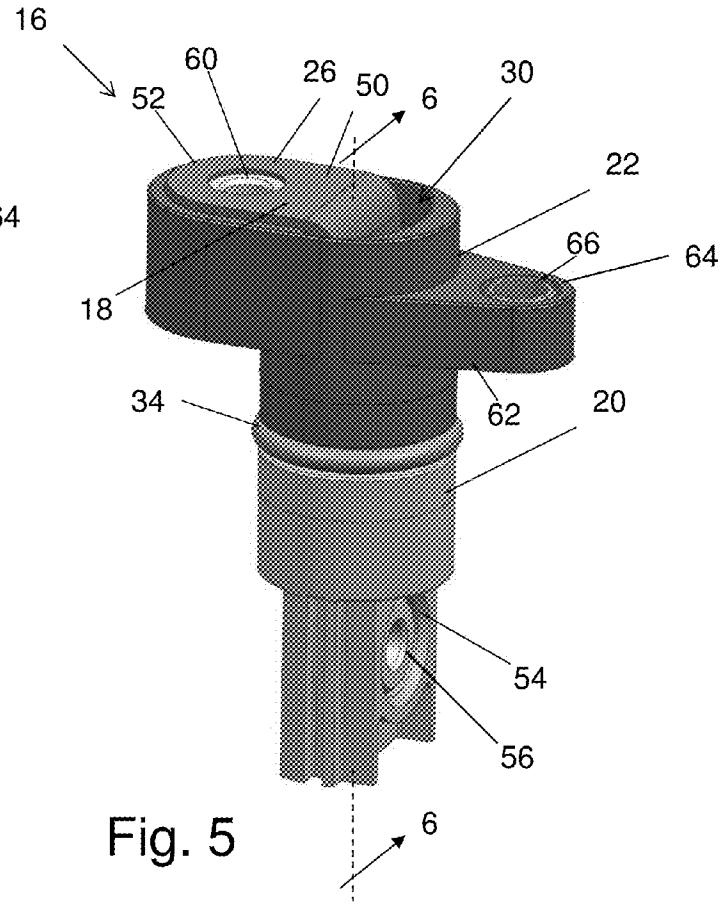
FIG. 5 is a perspective view of the assembled electric header.

Referring to FIG. 5, the assembled electric header 16 is shown. The inner end 46 of the electric terminal 18 and the insertion end 32 of the external header part 22 are inserted into the interior terminal opening 28 of the interior header part 20. The insertion end 32 is adapted to mate with the interior terminal opening 28, and the illustrated insertion end 32 and interior terminal opening 28 are male and female connections, respectively. However, it should be appreciated that the interior header part 20 and the outer header part 22 may have any desired mating configuration.

Figure 6:
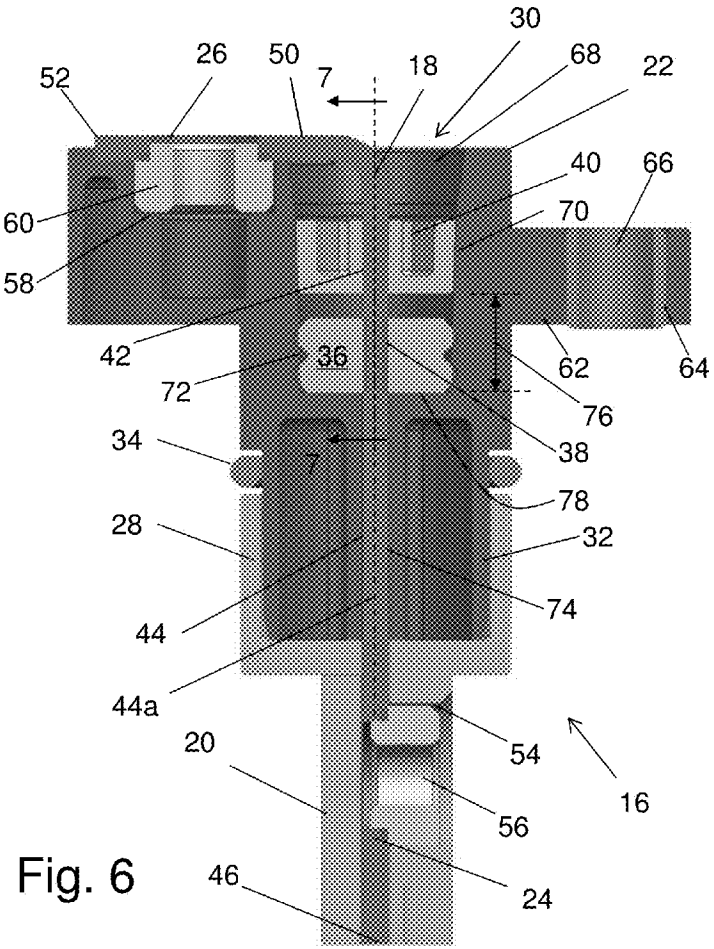
FIG. 6 is a cross-sectional view taken along line 6-6 of FIG. 5.

Referring to FIG. 6, a cross-sectional view of the assembled electric header, taken through the center of the electric terminal 18 along the line 6-6 of FIG. 5, is shown. The interior header part 20 defines an interior nut space 54 that is adapted to hold an interior clinch nut 56. The interior clinch nut 56 engages the interior termination opening 24 of the electric terminal 18 to attach the electric terminal 18 to the interior header part 20. Similarly, the exterior header part 22 defines an exterior nut space 58 that is adapted to hold an exterior clinch nut 60. The exterior clinch nut 60 engages the exterior termination opening 26 of the electric terminal 18 to attach the electric terminal 18 to the exterior header part 22. The illustrated interior clinch nut 56 and exterior clinch nut 60 include internal threads for connection of the electric current-carrying leads (not shown). It should be appreciated that the illustrated interior clinch nut 56 and exterior clinch nut 60 may be replaced with any desired connectors.

The exterior header part 22 includes a mount arm 62 that defines a mount through hole 64. The illustrated mount through hole 64 is adapted to accommodate a compression limiter 66. The compression limiter 66 is adapted to accommodate a mounting member (not shown) for attaching the electric header 16 to the transmission housing 10. It should be appreciated that the electric header 16 may be mounted on the transmission housing 10 using any other desired fastener or method.

Figure 7:
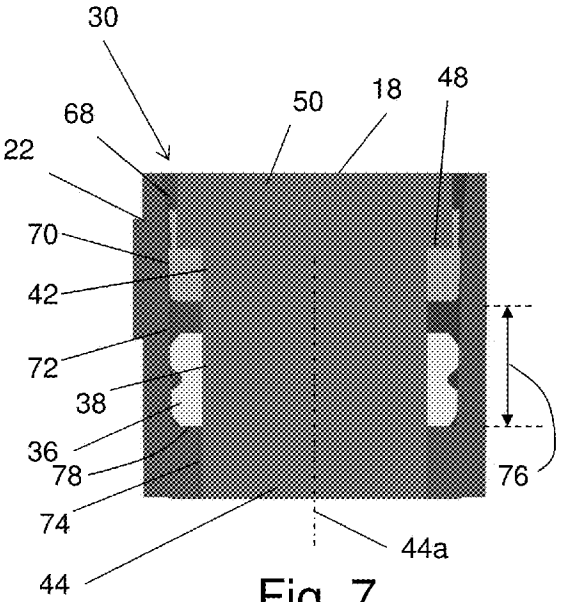
FIG. 7 is a cross-sectional view taken along line 7-7 of FIG. 6.

When assembled, the external terminal opening 30, the terminal seal 36, and the seal cap 40 provide a sealed housing for the electric terminal 18. The illustrated external terminal opening 30, defined by the external housing part 22, includes four areas. From the outermost to the innermost (moving downward as viewed in FIG. 6), they are: an external terminal entry 68, a cap seat 70, a seal space 72, and a terminal pass-through 74. These portions of the external terminal opening 30 are also identified on FIG. 7, which is a cross-sectional view taken through the center of the electric terminal 18 along line 7-7 of FIG. 6. The external terminal entry 68 is the portion of the external terminal opening 30 that the outer portion 50 of the electric terminal 18 passes through. The illustrated external terminal entry 68 narrows as it approaches the cap seat 70, but it may have any desired geometry. The cap seat 70 is the location where the seal cap 40 is located when the electric header 16 is assembled. As previously described, the location of the seal cap 40 relative to the electric terminal 16 is controlled by the terminal stop 48. The seal cap 40 engages the external housing part 22 to support the electric terminal 18 relative to the external housing part 22. The seal cap 40 also keeps the terminal seal 36 in position and helps protect the terminal seal 36 from damage The seal space 72 is the portion of the external terminal opening 30 that the terminal seal 36 is located in. The seal space 72 has a substantially oval shape in a cross-section taken perpendicular to the inner axis 44*a* and is adapted to accommodate the terminal seal 36 with the terminal seal 36 being compressed against the external housing part 22 and the electric terminal 18. The illustrated seal space 72 has a greater length 76 measured parallel to the electric terminal 18 than the terminal seal 36 does. This is to accommodate thermal variations changing the size of the terminal seal 36. The terminal pass-through 74 is a portion of the external terminal opening 30 that is adapted to allow passage of the electric terminal 18 and to prevent passage of the terminal seal 36. The illustrated terminal pass-through 74 is large enough for the inner portion 44 of the electric terminal 18 to pass through, but not large enough for the terminal seal 36 to pass through. Thus, the terminal seal 36 is maintained within the seal space 72 between the seal cap 40 and the terminal pass-through 74. The illustrated terminal pass-through 74 includes an outer end 78 with a wall that is generally perpendicular to the electric terminal 18. However, the outer end 78 may have any desired shape.

It should be appreciated that although the electric header 16 has been described in connection with the transmission housing 10, the electric header 16 may be used in any desired application. Further, it should be appreciated that the illustrated external terminal opening 30 and terminal seal 36 may be used in any application in which it is desired to provide a sealed electric connection. The preferred embodiment has been described using the terms "internal" and "external" as well as "inner" and "outer" in order to aid in the description of the illustrated embodiment. However, it should be appreciated that the use of these terms is not intended to place a limit on which relative side of a housing the described terminal seal 36 is used on.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A sealed terminal housing comprising:

a header defining a terminal opening;

an electric terminal extending through the terminal opening, the electric terminal including an inner end and a terminal stop, an inner axis being defined from the inner end to the terminal stop;

a terminal seal located in the terminal opening and compressed against the header and the electric terminal; and a seal cap located in the terminal opening and engaging the header and the terminal stop; wherein the terminal opening includes (1) a cap seat that has a substantially oval shape in a cross-section taken perpendicular to the inner axis and the seal cap is located in the cap seat, (2) a terminal pass-through that is adapted to allow passage of the electric terminal and to prevent passage of the terminal seal, and (3) a seal space located between the cap seat and the terminal pass-through.

2. The sealed terminal housing of claim 1, wherein the terminal seal defines a seal terminal opening that the electric terminal passes through, and the seal cap defines a cap terminal opening that the electric terminal passes through.

3. The sealed terminal housing of claim 2, wherein the electric terminal includes an inner portion that extends from an inner end of the electric terminal to the terminal stop, and an outer portion that extends from the terminal stop to an outer end of the terminal, and wherein the inner portion of the electric terminal passes through the seal terminal opening and the cap terminal opening.

4. The sealed terminal housing of claim 3, wherein the outer portion of the electric terminal is wider than the inner portion of the electric terminal.

5. The sealed terminal housing of claim 1, wherein the terminal seal has a substantially oval shape in a cross-section taken perpendicular to the inner axis when the terminal seal is not compressed against the header.

6. The sealed terminal housing of claim 1, wherein the seal cap has a substantially oval shape in a cross-section taken perpendicular to the inner axis.

7. The sealed terminal housing of claim 1, wherein the seal space has a substantially oval shape in a cross-section taken perpendicular to the inner axis.

8. The sealed terminal housing of claim 1, wherein the seal space has a greater length measured parallel to the electric terminal than the terminal seal.

9. An electric header comprising:

a header part including a terminal opening defining an axis and having a cap seat portion that is substantially oval in cross-sectional shape perpendicularly relative to the axis, a seal space portion, and a terminal pass-through portion;

an electric terminal including a portion that extends from a terminal stop through the terminal pass-through portion of the terminal opening to an end;

a terminal seal that is disposed within the seal space portion of the terminal opening and is compressed between the header part and the electric terminal; and a seal cap that is disposed within the cap seat portion of the terminal opening and engages the header part and the terminal stop.

10. The electric header of claim 9, wherein the header part is an external header part, and further including an internal header part that is supported on external header part.

11. The electric header of claim 10, wherein the internal header part includes an interior terminal opening through which the portion of the electric terminal extends.

12. The electric header of claim 9, wherein the portion of the electric terminal is an inner portion and the end is an inner end, and wherein the electric terminal further includes an outer portion that extends from the terminal stop to an outer end.

13. The electric header of claim 12, wherein the outer portion of the electric terminal is wider than the inner portion of the electric terminal.

14. The electric header of claim 9, wherein the portion of the electric terminal is an inner portion and the end is an inner end, and wherein the electric terminal further includes an outer portion that extends generally perpendicularly from the inner portion.

15. The electric header of claim 9, wherein the seal space portion of the terminal opening has a greater length, when measured parallel to the electric terminal, than the terminal seal.

* * * * *